US005201874A

United States Patent [19]

Kiehn

[11] Patent Number: 5,201,874

[45] Date of Patent: Apr. 13, 1993

[54] BOWLING BALL SUPPORT FOR THE FOREARM

[76] Inventor: Walter Kiehn, 7030 Flamingo Way, Sacramento, Calif. 95828

[21] Appl. No.: 725,298

[22] Filed: Jul. 3, 1991

[51] Int. Cl.[5] ..... A63B 71/14

[52] U.S. Cl. ..... 273/54 B; 273/37

[58] Field of Search ..... 273/37, 54 R, 54 B, 273/64

[56] References Cited

U.S. PATENT DOCUMENTS 3,033,567 5/1962 Raab ..... 273/54 B 3,438,630 4/1969 Petti ..... 273/54 B 3,606,319 9/1971 Borden ..... 273/54 B 3,829,090 8/1974 Ensinger ..... 273/54 B

*Primary Examiner*—V. Millin

*Assistant Examiner*—William M. Pierce

[57] ABSTRACT

A bowling device that consists of a molded plastic slightly curved rectangle, approximately 4"×5" and 1" thick, which is attached with an adjustable Velcro strap to either lower arm, immediately above the wrist to act as a support for a bowling ball. The curved portion of the device is approximately of the same curvature as the surface of most bowling balls.

7 Claims, 4 Drawing Sheets

B
.60"
H
.30"
38°
.10"
R4-3/16"
G
F
E
A
.10"
L
M

BOWLING BALL SUPPORT FOR THE FOREARM

SUMMARY OF THE INVENTION

This device, strapped onto either arm, enables a bowler to improve his or her bowling ability by eliminating the necessity of inserting their thumb (and fingers) in the thumb-hole (and finger holes) of the bowling ball. (Throwing a bowling ball without the use of the thumb and/or fingers is allowed by the rules of bowling.)

Not using the thumb allows the ball to spin faster, enabling a greater curve to be described by the ball's path down the bowling lane, thus driving at a sharper angle into the strike pocket, increasing the probability of knocking over more pins at one time, thereby increasing the bowler's success at the game.

In addition, the device helps beginners learn more quickly and enables a greater number of disabled persons to bowl or improve their bowling.

DETAILED DESCRIPTION

Figure 1:
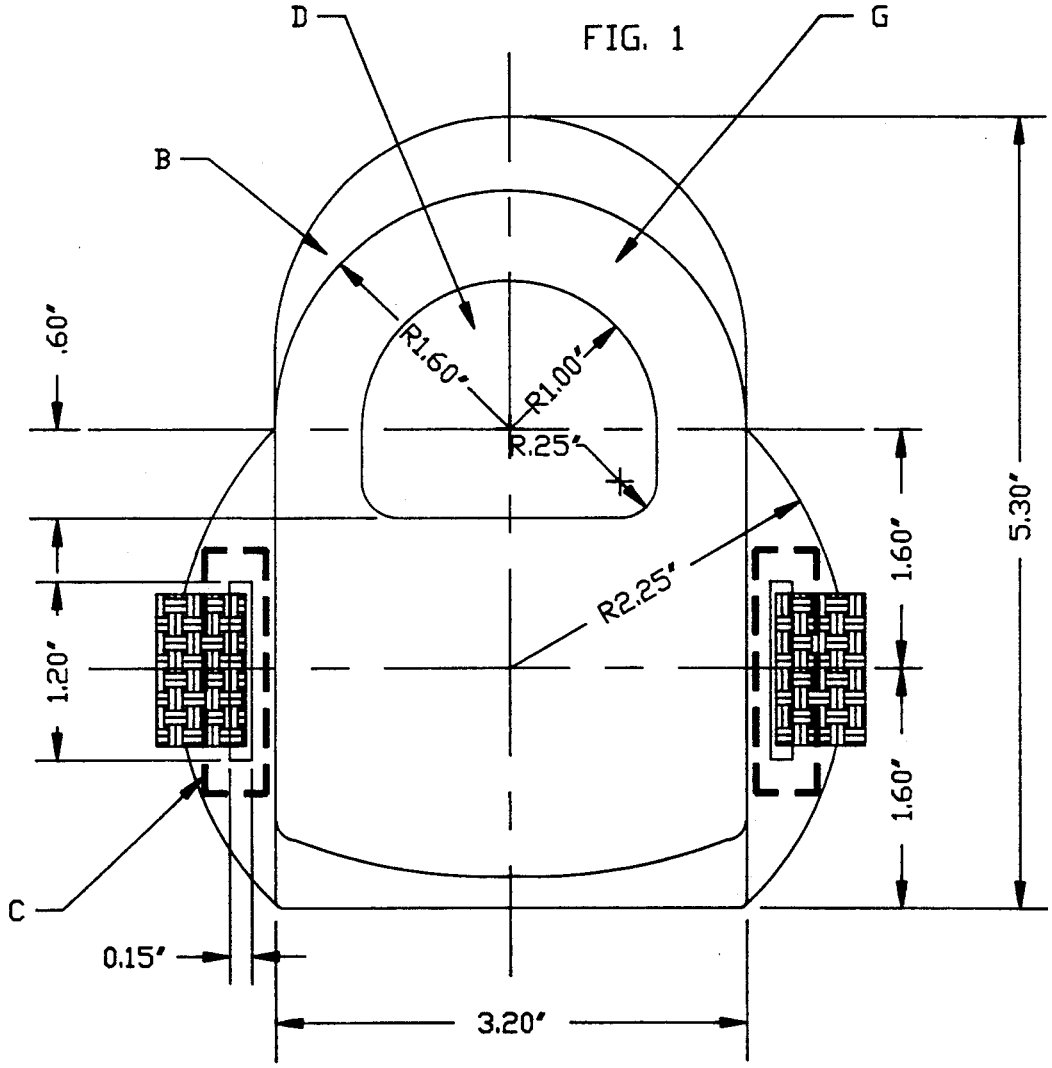
FIG. 1 is a top view of the device. The edge of the device is at the bottom of the page and would be approximately where the wearer's wrist would be.
Figure 2:
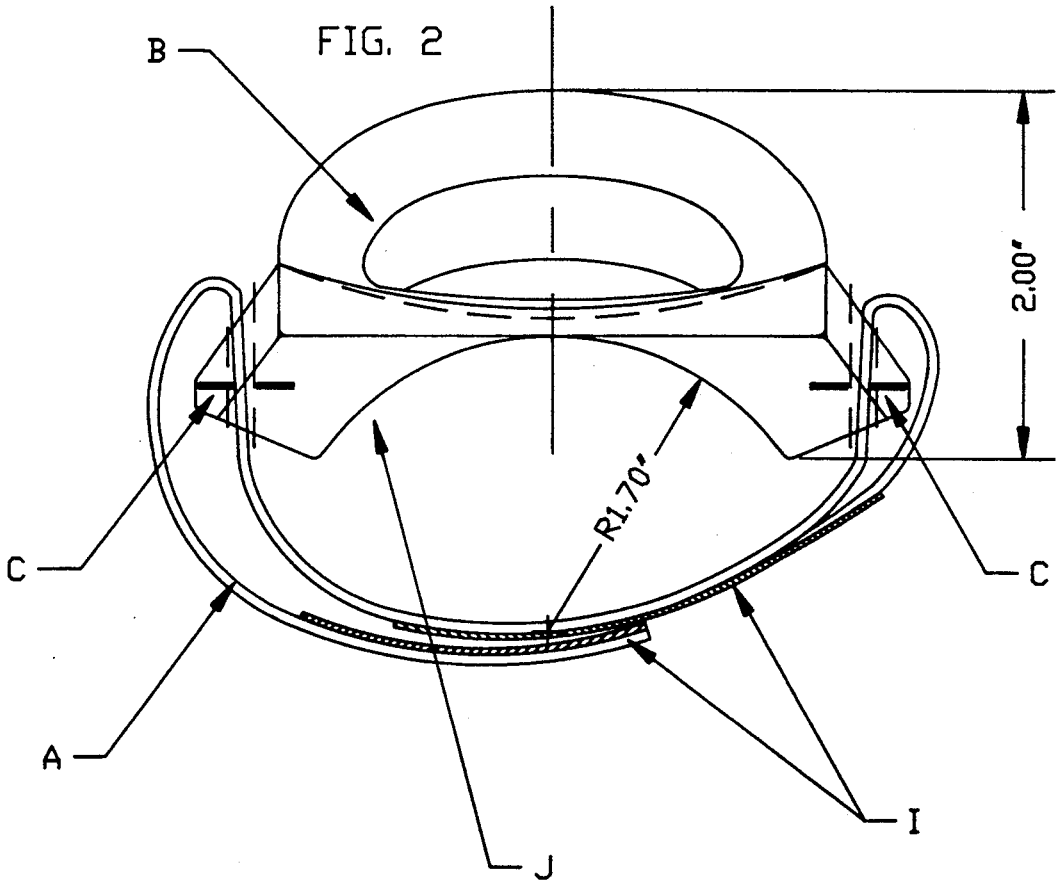
FIG. 2 is a front edge view of the device, this edge being closest to the wearer's wrist.
Figure 3:
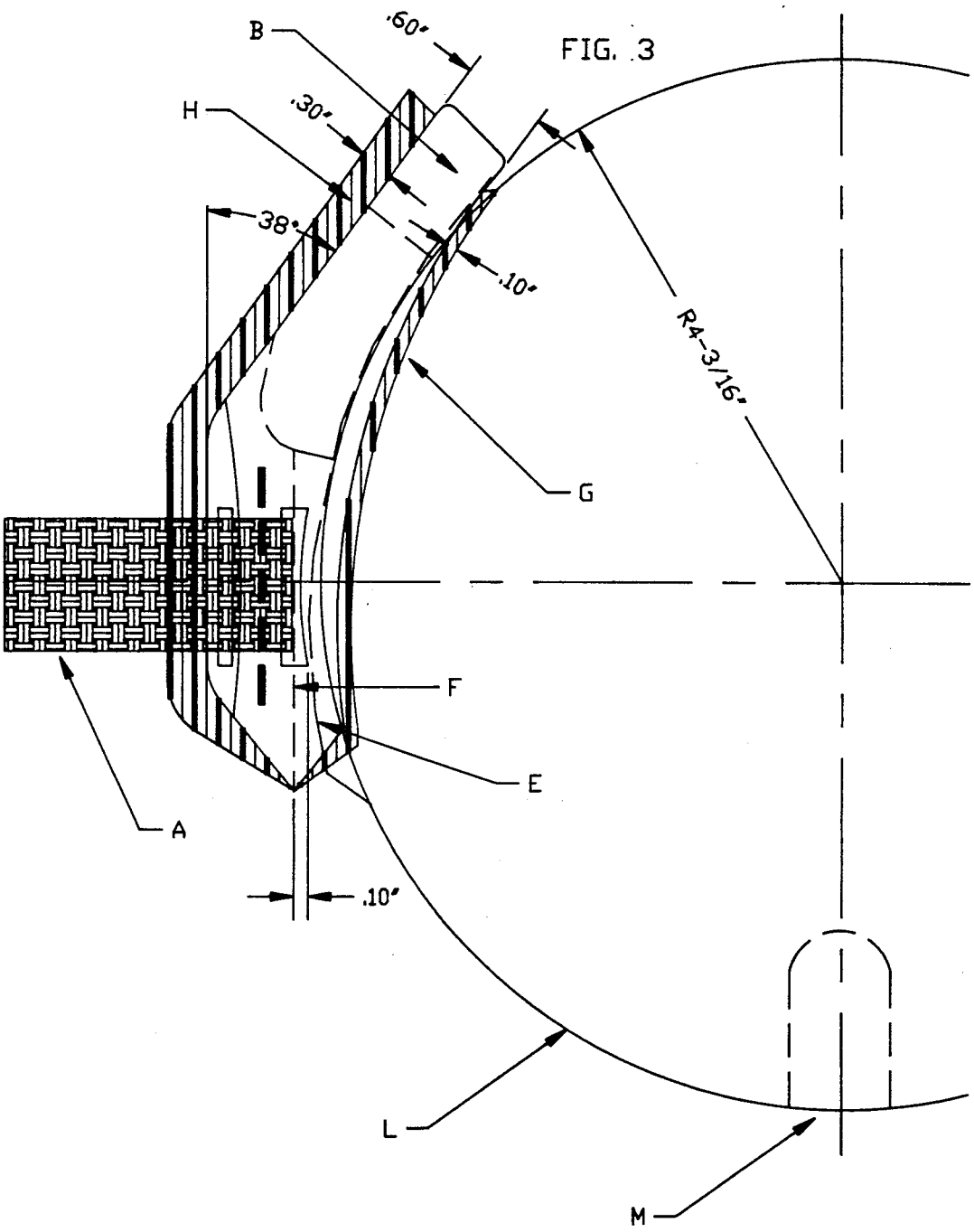
FIG. 3 is a side view of the device, showing how it aligns with the bowling ball. The view from the opposite side would be identical, except in reverse.
Figure 4:
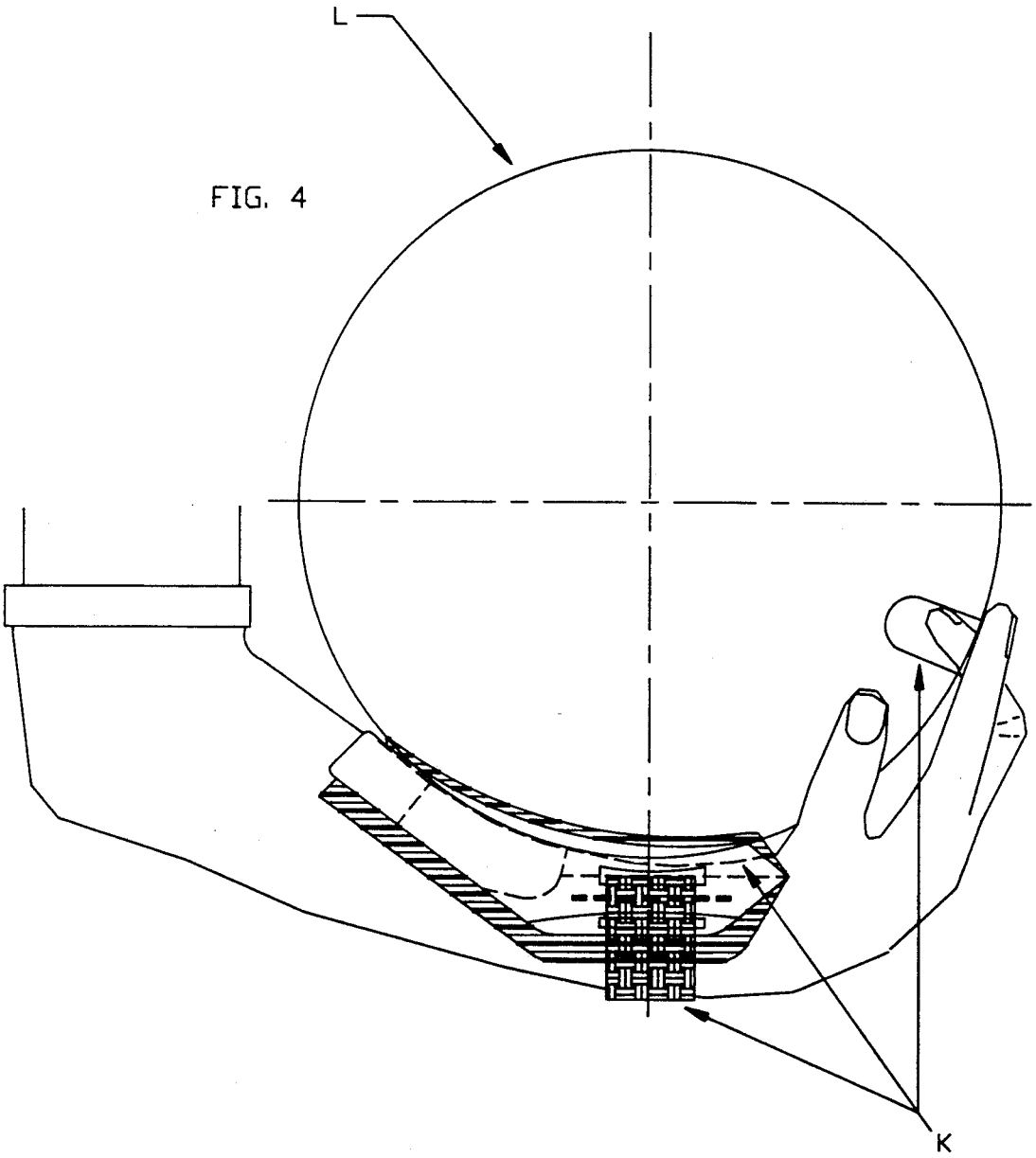
FIG. 4 shows how the device fits onto the arm of the bowler. (Figure for Official Gazette)

Drawing 1 is a top view of the device. The edge of the device is at the bottom of the page and would be approximately where the wearer's wrist would be.

"B" indicates that the major part of the device is made from flexible polyester resin covered with felt.

"C" indicates steel reinforcement in the strap holes, imbedded in the polyester resin, and therefore not visible.

"D" indicates a hole in the major part of the device, the sole function of which is to reduce the weight of the device.

"G" indicates the area covered by felt.

Drawing 2 is a front edge view of the device, this edge being closes to the wearer's wrist. The wrist is not shown.

"A" indicates the strap made of nylon and Velcro.

"I" indicates the Velcro portions of the straps. By adjusting the overlap of the strap ends, the device can accommodate different size arms.

"J" indicates the curve in the underside of the main part of the device which fits the shape of the wearer's arm.

Drawing 3 is a side view of the device, showing how it aligns with the bowling ball. The view from the opposite side would be identical, except in reverse.

"E" indicates the curve of the main part of the device which is the shape or contour of the bowling ball.

"F" indicates the curve of the main part of the device which fits the wearer's arm. The surface and edge of this curve is not visible from this view; however, the curve portrayed on the drawing is at the centerline of the device when viewed from the bottom.

"H" indicates a layer of sponge rubber glued to the entire bottom of the device, and which follows the contour of the bottom of the device.

"K" indicates the device strapped to the arm above the wrist with the ball in the guide and finger in the finger hole in the ball for delivering.

"L" indicates the outline of the bowling ball when aligned with the device.

"M" indicates a finger hole in the bowling ball.

Drawing 4 shows how the device fits onto the arm of the bowler. The same device can be used for either the left or right arm. The device can be manufactured in several sizes for different size arms, including children. No more than four different sizes would be required. The device could also be manufactured in different colors.

I claim:

1. A bowling device to be worn on the forearm of a bowler and for use with a bowling ball comprising a main part with an angularly extending U-shaped portion extending from an end of the main part, said main part and extending portion having a topside (G), an underside (J) and opposed sides, the underside having a contoured shape adapted to fit the shape of the forearm of a bowler, the topside having a concave shape having a radius of curvature substantially equal to that of the bowling ball and a means to adjustably connect said main part to the forearm of the bowler.

2. A bowling device as in claim 1 wherein the means to adjustably connect includes a velcro strap.

3. A bowling device as in claim 2 wherein the means to adjustably connect includes holes in said opposed sides of the main part that are steel reinforced (C) through which said velcro strap pass.

4. A bowling device as in claim 1 wherein the underside is covered with a layer of sponge rubber (H).

5. A bowling device as in claim 1 wherein said main part is made from a flexible polyester resin.

6. A bowling device as in claim 1 wherein the main part is covered with felt (B).

7. A bowling device as in claim 1 wherein said U-shaped extension forms an angle of 38 degrees with respect to the underside of the main portion.

* * * * *